US010427757B2

(12) United States Patent
Serocki

(10) Patent No.: US 10,427,757 B2
(45) Date of Patent: Oct. 1, 2019

(54) CROSS TIE TUBE ASSEMBLY

(71) Applicant: Philip J. Serocki, Sparta, TN (US)

(72) Inventor: Philip J. Serocki, Sparta, TN (US)

(73) Assignee: Taco Metals, Inc., Miami, FL (US)

( * ) Notice: Subject to any disclaimer, the term of this patent is extended or adjusted under 35 U.S.C. 154(b) by 0 days.

(21) Appl. No.: 15/842,618

(22) Filed: Dec. 14, 2017

(65) Prior Publication Data

US 2018/0194434 A1 Jul. 12, 2018

Related U.S. Application Data

(60) Provisional application No. 62/434,050, filed on Dec. 14, 2016.

(51) Int. Cl.

| | |
|---|---|
| ***B63B 17/00*** | (2006.01) |
| ***B63B 21/06*** | (2006.01) |
| ***B63B 21/54*** | (2006.01) |

(52) U.S. Cl.

CPC ..... *B63B 21/06* (2013.01); *B63B 17/00* (2013.01); *B63B 21/54* (2013.01)

(58) Field of Classification Search

CPC ..... B63B 21/06; B63B 21/54; B63B 17/00
See application file for complete search history.

(56) References Cited

U.S. PATENT DOCUMENTS

| | | | | |
|---|---|---|---|---|
| 1,770,967 | A | 8/1928 | Bean | |
| 2,670,981 | A * | 3/1954 | Wenham | E05C 3/14 292/114 |
| 3,034,470 | A * | 5/1962 | Vanderfeltz | B63B 35/816 114/218 |
| 3,703,875 | A * | 11/1972 | Gunvalson | B63B 21/04 114/230.29 |
| 3,771,488 | A | 11/1973 | Ecke | |
| 5,185,992 | A * | 2/1993 | Garcia | A01B 1/227 56/400.04 |
| 6,487,984 | B1 * | 12/2002 | Pape | B63B 21/045 114/218 |
| 6,644,230 | B1 | 11/2003 | Webster | |
| 7,302,900 | B1 | 12/2007 | Stefano | |
| 7,318,390 | B2 | 1/2008 | Amy | |
| 7,520,233 | B1 | 4/2009 | Lyon | |
| 9,789,931 | B2 | 10/2017 | Czipri | |
| 2011/0083356 | A1 | 4/2011 | Rupp | |
| 2013/0145976 | A1 | 6/2013 | Yeames | |
| 2014/0182502 | A1 | 7/2014 | Camardelle | |

* cited by examiner

*Primary Examiner* — Stephen P Avila
(74) *Attorney, Agent, or Firm* — Robert M. Schwartz; Alfred K. Dassler

(57) ABSTRACT

A tube guide assembly for mounting in a rod holder of a vessel. The rod holder has a depth from a cross member to a top surface. The assembly secures a mooring line to the vessel. The assembly includes a tube having a longitudinal axis and a base end dimensioned to be disposed in the rod holder to engage the cross member. The tube has a second end opposite the base end. The second end has a cleat to secure the mooring line. The tube has inverted J-shaped slots opposite one another to receive the cross member therein. A spring-loaded lock assembly is disposed in the tube. The lock assembly has a plunger to press against the cross member and lock the cross member in the J-shaped slots.

11 Claims, 8 Drawing Sheets

CROSS TIE TUBE ASSEMBLY

CROSS-REFERENCE TO RELATED APPLICATION

This application claims benefit of U.S. Provisional Patent Application No. 62/434,050 filed Dec. 14, 2016, titled Cross Tie Tube Assembly. The prior application is incorporated herein in its entirety.

BACKGROUND OF THE INVENTION

Field of the Invention

The present invention pertains to a mooring line cross tie tube assembly on a marine vessel.

U.S. Pat. No. 6,487,984 discloses a portable boat cleat assembly that includes a rod member that is sized and shaped for being received in a rod holder of a boat. The assembly includes a base plate that rests against a surface of a boat hull when placed into a mounted position in the rod holder. The bottom of the rod member is provided with opposing inverted L-shaped cutouts that engage a cross-member of the rod holder. U.S. Pat. No. 6,487,984 accordingly provides a cleat that is positioned similar to a fixed cleat on the gunwale of the boat. The portable cleat can be used for temporarily securing a vessel to a dock/structure or for hanging fenders, chum or bait baskets, or other accessories over the edge of the vessel. While U.S. Pat. No. 6,487,984 does disclose a height adjustment of rod member, however, such is only to make sure that sufficient length is provided to engage the cross member at the bottom of the rod holder. Therefore, U.S. Pat. No. 6,487,984 does not address the issue of providing clearance for mooring lines from housings of an outboard motor and prevent rubbing of such mooring lines on the cowling of an outboard motor. Additionally, the inverted L-shaped cutouts of U.S. Pat. No. 6,487,984 are not provided with any mechanism for preventing the cutouts from becoming disengaged from the cross-member of the rod holder due to the vessel being moved by tidal action, wave action and wind.

SUMMARY OF THE INVENTION

It is accordingly an object of the invention to provide a tube assembly that can be securely fixed in a rod holder for raising mooring lines up above the cowlings of outboard engines on a vessel, which overcomes the hereinafore-mentioned disadvantages of the heretofore-known devices of this general type and which prevents damage to the increasing numbers of outboard motors being provided across the stern of vessels.

With the foregoing and other objects in view there is provided, in accordance with the invention, a tube guide assembly for mounting in a rod holder of a vessel. The rod holder has a depth from a cross member to a top surface. The assembly secures a mooring line to the vessel. The assembly includes a tube having a longitudinal axis and a base end dimensioned to be disposed in the rod holder to engage the cross member. The tube has a second end opposite the base end. The second end has a cleat to secure the mooring line. The tube has inverted J-shaped slots opposite one another to receive the cross member therein. A spring-loaded lock assembly is disposed in the tube. The lock assembly has a plunger to press against the cross member and lock the cross member in the J-shaped slots.

In accordance with another development of the invention, the lock assembly includes a spring. A locking collar is fixed in the tube and a plunger ring is fixed to the plunger. The plunger includes a shaft. The spring is retained on the shaft between the locking collar and the plunger ring.

In accordance with a further development of the invention, the lock assembly includes a male fastener that affixes the plunger ring to the shaft. The spring is retained on the shaft between the locking collar and the plunger ring.

In accordance with an added development of the invention, a roll pin is provided. The locking collar has a transverse collar hole and the tube has a transverse wall hole corresponding to the collar hole. The roll pin is disposed in the transverse wall hole and the collar hole to secure the lock assembly in the tube.

In accordance with an additional development of the invention, a sleeve is disposed over the tube at the base end. The sleeve is disposed over the roll pin to retain the roll pin in the locking collar.

In accordance with yet another development of the invention, the sleeve is made of Delrin.

In accordance with yet a further development of the invention, the cleat has a base and the base has a substantially round hole formed through the base.

In accordance with still yet a further development of the invention, the edges of the hole have a corner radius to prevent the mooring line from chafing.

In accordance with yet still another development of the invention, the the substantially J-shaped slots have insertion legs opening into a circumferential edge of the base end that extend substantially parallel to the longitudinal axis. The distal longitudinal legs are spaced apart from the insertion legs and extend substantially parallel to the insertion legs. The distal longitudinal legs have terminal ends, the J-shaped slots have transverse portions that connect the insertion legs to the distal legs. The plunger presses the terminal ends against the cross member to seat and lock the tube in the rod holder.

In accordance with a concomitant development, there is a tube guide assembly for mounting in a rod holder of a vessel. The rod holder has a top surface mounted at a gunwale top surface. The assembly secures a mooring line to the vessel. The assembly includes a tube that has a longitudinal axis and a base end dimensioned to be disposed in the rod holder and to engage the cross member. The tube has a second end opposite the base end. The second end has a cleat for securing the mooring line. The tube has a length from the base end over the cleat to dispose a top surface of the cleat at least 15 inches over the gunwale top surface to support the mooring line above engine cowling of an outboard engine mounted on the vessel and to prevent the mooring line from damaging the engine cowling when the base end is disposed in the rod holder and engaged with the cross member.

In accordance with an additional development, there is a tube guide assembly to mount in a rod holder of a vessel. The rod holder has a cross member and the vessel has an outboard motor mounted thereon. The outboard motor has an engine cowling with an uppermost surface. The assembly secures a mooring line to the vessel. The assembly includes a tube that has a longitudinal axis and a base end dimensioned to be disposed in the rod holder and engage the cross member. The tube has a second end opposite the base end. The second end has a cleat to secure the mooring line. The tube has a length to dispose the cleat above the uppermost surface of the engine cowling when the base end is disposed in the rod holder engaged with the cross member.

Other features which are considered as characteristic for the invention are set forth in the appended claims.

Although the invention is illustrated and described herein as embodied in cross tie tube assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE DRAWINGS

Figure 6:
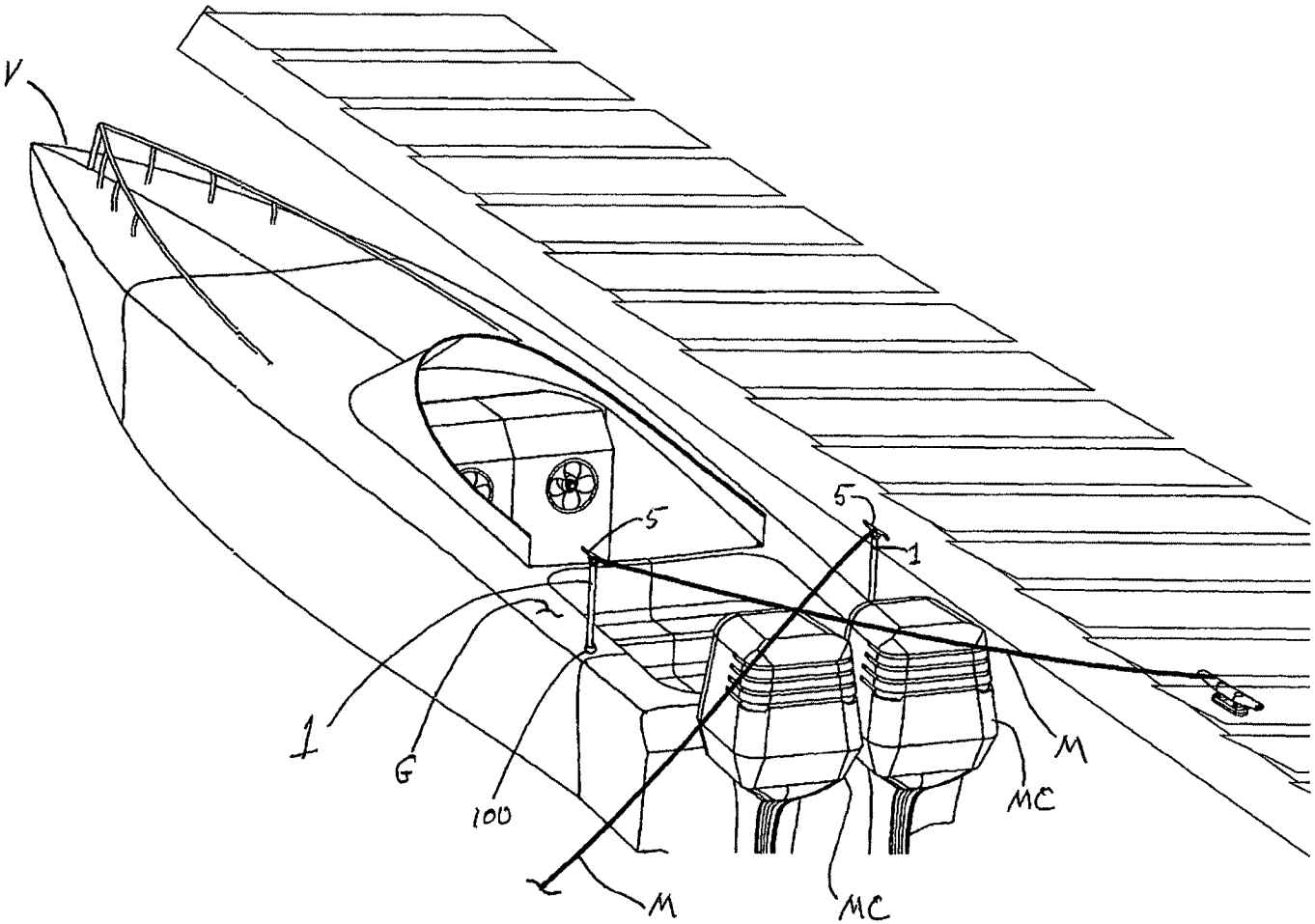
FIG. 6 is a boat with two tube assemblies and corresponding mooring line suspended above the engines showing the boat vessel at a dock.

As seen in FIG. 6, the tube assemblies 1 are provided to hold docking/mooring lines M above outboard motor cowlings and thus prevent scuffing and damage to the outboard motor cowlings due to rubbing that results from motion of a vessel V when docked. As seen in FIG. 6, the tube assemblies 1 may be mounted within the tubular rod holders 100 of the vessel, which are disposed below the gunwales.

Figure 1:
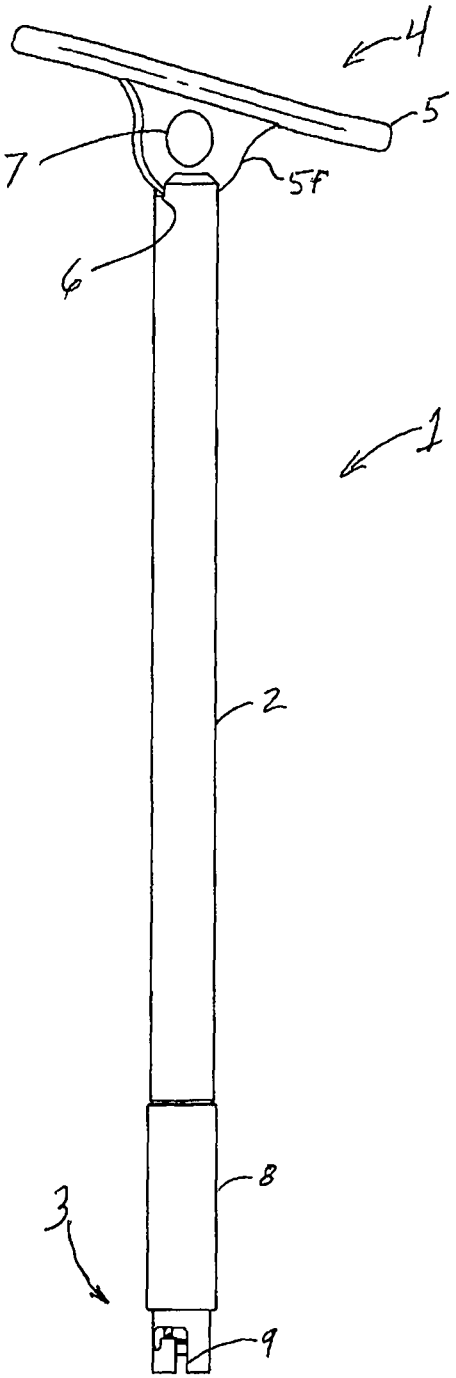
FIG. 1 is a side view of a tube assembly.
Figure 2:
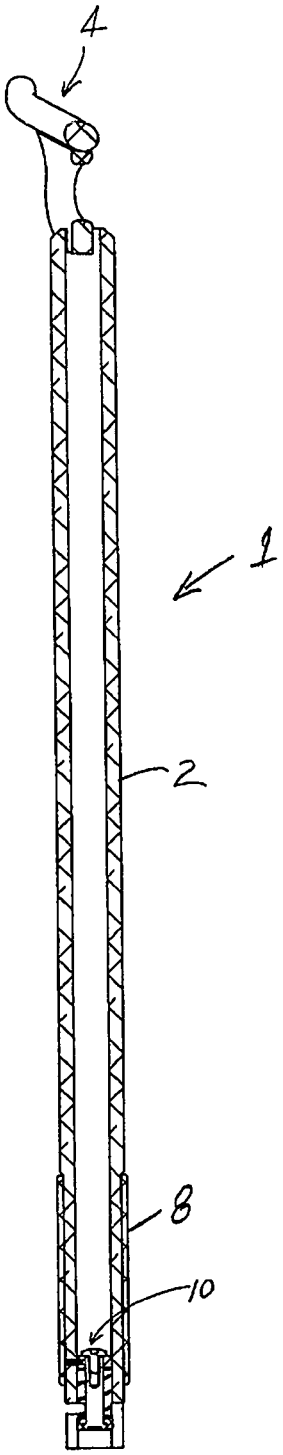
FIG. 2 is a section view of FIG. 1 along the section line A-A.

FIG. 1 shows that the tube assembly 1 has a tube 2 with a base end 3 for mounting the tube assembly 1 to the vessel V. The tube 2 has a guide or cleat end 4 opposite the base end 3. The guide end 4 is provided with a cleat 5 having a flange **5*f* that is mounted in opposing slots 6 that are formed in the guide end 4 of the tube 2. The flange 5*f* is disposed in the slots 6 and is welded to the tube 2 to hold the cleat 5 in place. A mooring line M can be tied off on the cleat 5. The flange 5*f* of the cleat 5 may have a substantially round hole 7 formed therein though which the mooring line M can be fed and subsequently guided to a cleat that is provided on the vessel, where the mooring line M can be tied off. The length of the tube 2 is long enough that the mooring line M affixed in either manner (to the cleat 5 or through the hole 7) is held above the motor cowlings MC. Both edges of the hole 7** are provided with a radius and may have a smooth surface finish that is preferably polished so as to minimize wear/chaffing on the mooring line M, caused by movements of the vessel when docked.

The base end 3 of the tube 2 may be provided with a sleeve/liner 8 that is dimensioned to fit in the tubular rod holder 100 with minimal clearance so as to minimize movements of the tube assembly 1. It is preferably for the liner 8 to be of Delrin, a Registered Trademark of E.I. Du Pont De Nemours and Company Corporation, Wilmington, Del., or similar material. The base end 3 of the tube 2 is provided with two opposing substantially J-shaped slots 9 that are 180° apart that open out in the circumferential edge of the base end of the tube 2 and receive a cross pin/member 101 of the rod holder 100 therein.

Figure 3:
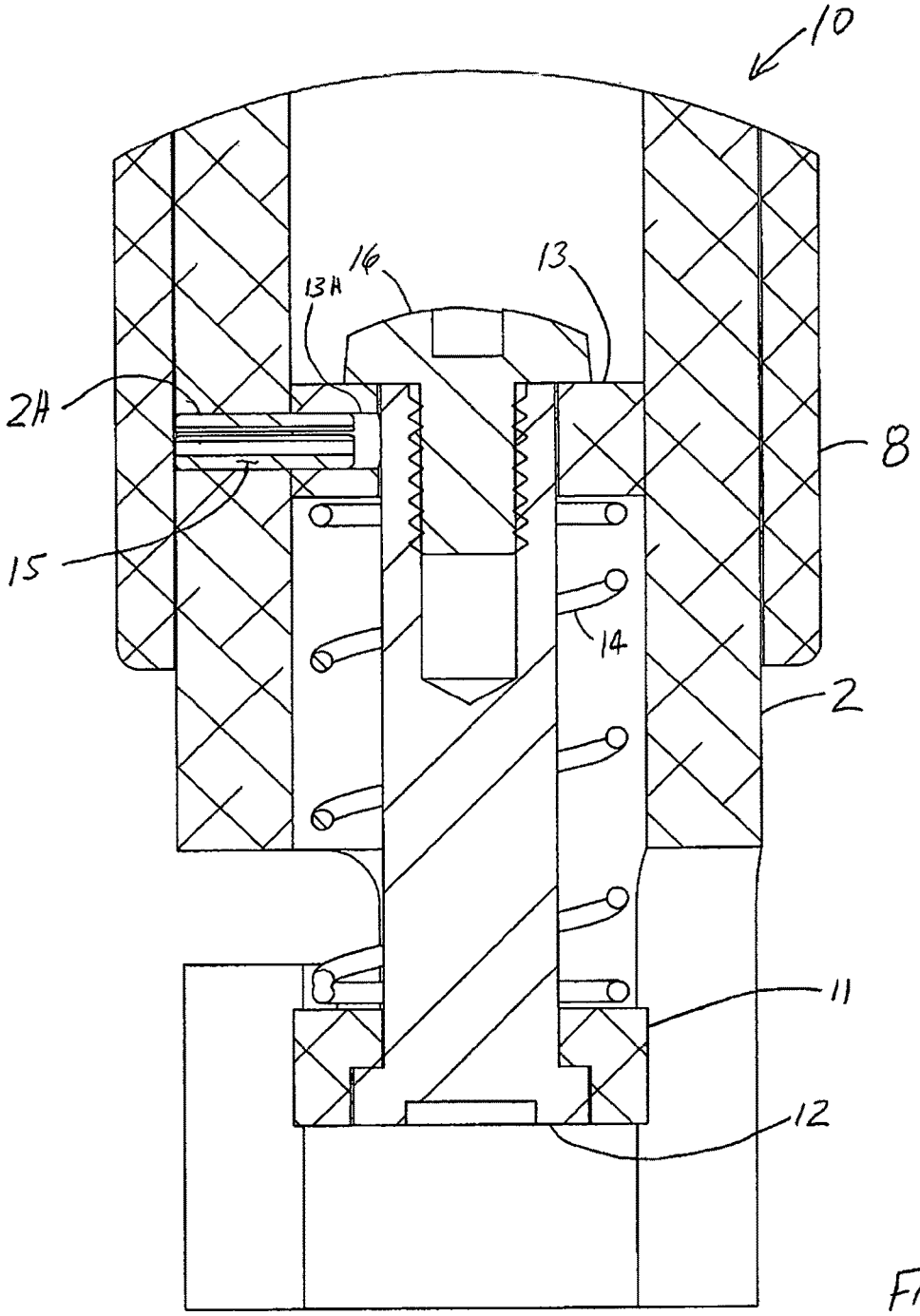
FIG. 3 is an enlarged view of detail B of FIG. 2.
Figure 4:
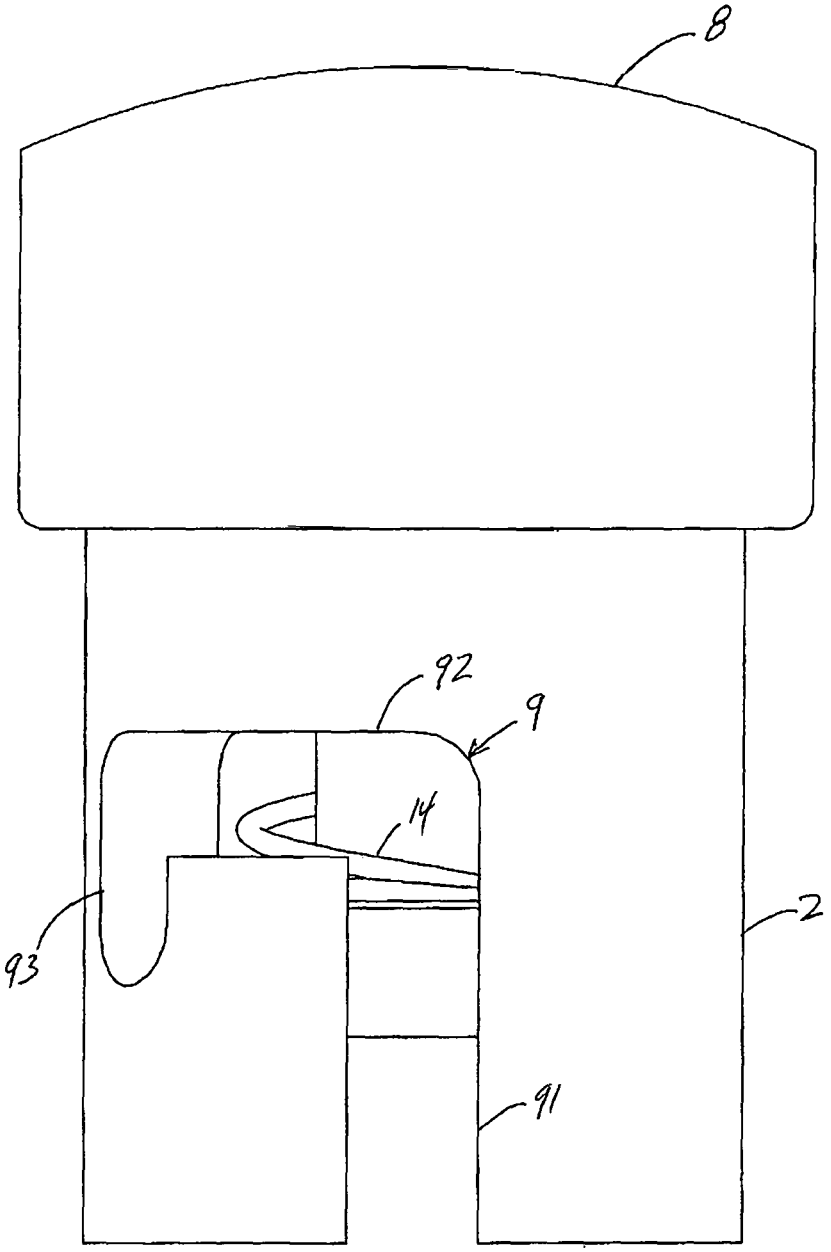
FIG. 4 is an enlarged view of detail C of FIG. 1.
Figure 5:
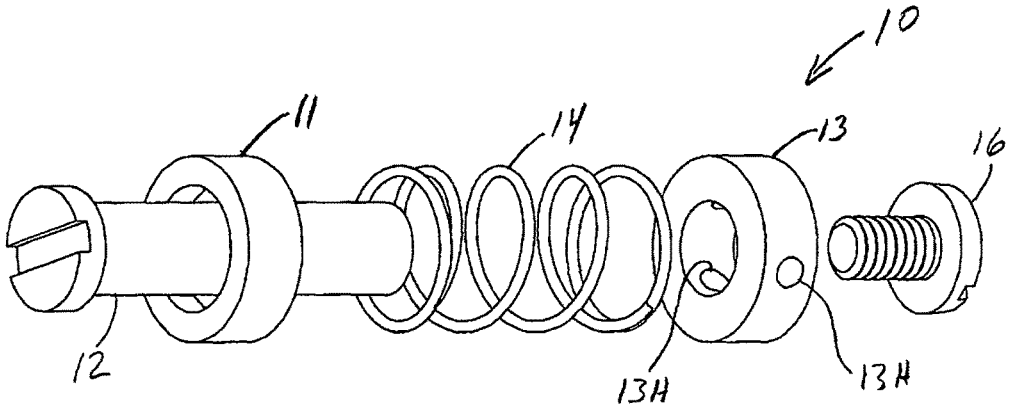
FIG. 5. is an exploded view of a plunger assembly of FIG. 3.

In order to further secure the tube assembly 1 in the rod holder 100, the base end 3 has a lock assembly 10. The lock assembly 10 is shown enlarged in FIG. 3 and exploded in FIG. 5. As seen in FIG. 5 the lock assembly 10 includes a plunger ring 11 and a ring shaped locking collar 13. A spring 14 is disposed between the plunger ring 11 and the collar 13. A plunger 12 passes through the plunger ring 11 and the spring 14 into the collar 13. The plunger 12 has a head portion and a shaft portion. The plunger ring 11 has an inside diameter that accommodates the head portion and a smaller inside diameter that accommodates the shaft portion. The transition between the IDs defines a shoulder which the head portion abuts against when assembled. The plunger ring 11 has an OD that provides a sliding fit with respect to an ID of the tube 2 and allows the plunger ring 11 to slide along the longitudinal direction of the tube 2. Likewise, the collar 13 has an ID that corresponds to an OD of the shaft of the plunger 12 for allowing the plunger 12 to slide through the collar 13 when the plunger 12 is compressed against the spring 14. The plunger 12 is provided with a female threaded hole at an end of the shaft for receiving a screw 16, which holds the assembly 10 together and which may slightly compress the spring 14 between the collar 13 and the ring 11 for preloading the spring 14. When the tube 2 is inserted into the rod holder 100, the plunger 12 is pressed by the cross pin 101 of the rod holder 100. The collar 13 is provided with radially distributed holes 13H, the tube 2 has corresponding holes 2H. After the assembly 10 is assembled, the assembly 10 is slid into the tube 2. Subsequently, roll pins 15 are pressed through the holes 2H into the holes 13H to hold the assembly in the tube 2. The liner 8 is mounted on the tube 2 so as to cover the holes 2H and retain the roll pins 15 and prevent the roll pins 15 from falling out.

In use, when the tube 2 is placed in the rod holder 100 the cross pin 101 of the rod holder 100 slides into first longitudinal legs 91 of the J-shaped slots 9, which open out into a circumferential edge of the base end 3 of the tube 2. The cross pin 101 presses against the plunger 12 and/or the plunger ring 11 (the head of the plunger 12 may be flush or below the plunger ring 11). This in turn causes the plunger ring 11 to move into in the tube 2 and compress the spring 14 until the cross pin 101 bottoms out on longitudinal legs 91 of the J-shaped slots 9. The tube 2 is then rotated through transverse portions 92 of the J-shaped slot until the cross pin 101 reaches the ends of the transverse portions 92. Then the tube 2 is released and the spring 14 extends and pushes the plunger 12 against the cross pin 101 and displaces the tube 2 in the longitudinal direction to seat the cross pin 101 against terminal ends of distal longitudinal legs 93 of the J-shaped slots 9, thus locking the assembly 1 into place in the rod holder 100. The locked position precludes an unintentional rotation of the assembly by the fact that the cross pin 101 is seated against the terminal ends of the distal longitudinal legs 93 and cannot not be rotated out of the transverse portions 92. Such a locking maintains the assembly 1 in the mounted position and prevents the assembly 1 from being pulled out due to movements of the vessel due to the effects of tide (height change and current), wind, and wave action. After the assembly 1 is locked into the rod holder 100 the mooring lines M can be attached as desired by the user. The release and removal of the assembly 1 is only possible by intentional action of the user compressing the spring 14 and rotating the tube 2 so that the cross member 101 can be pulled out of the J-shaped slot 90 to remove the assembly 1 from the rod holder 100.

Figure 7:
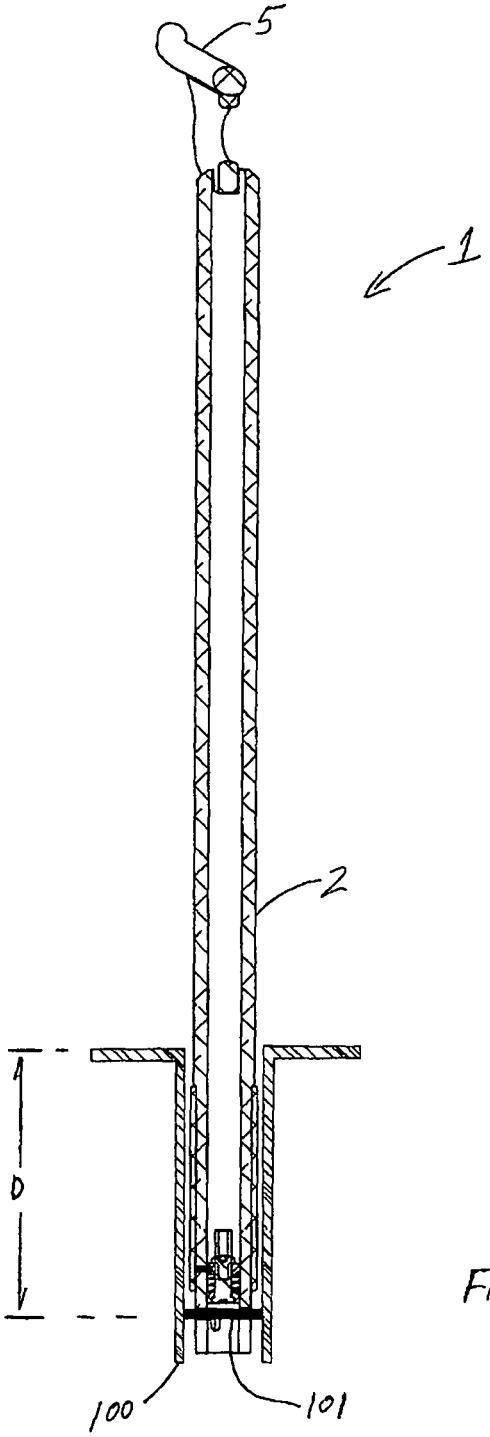
FIG. 7 is a section view of the assembly mounted in a rod holder.
Figure 8:
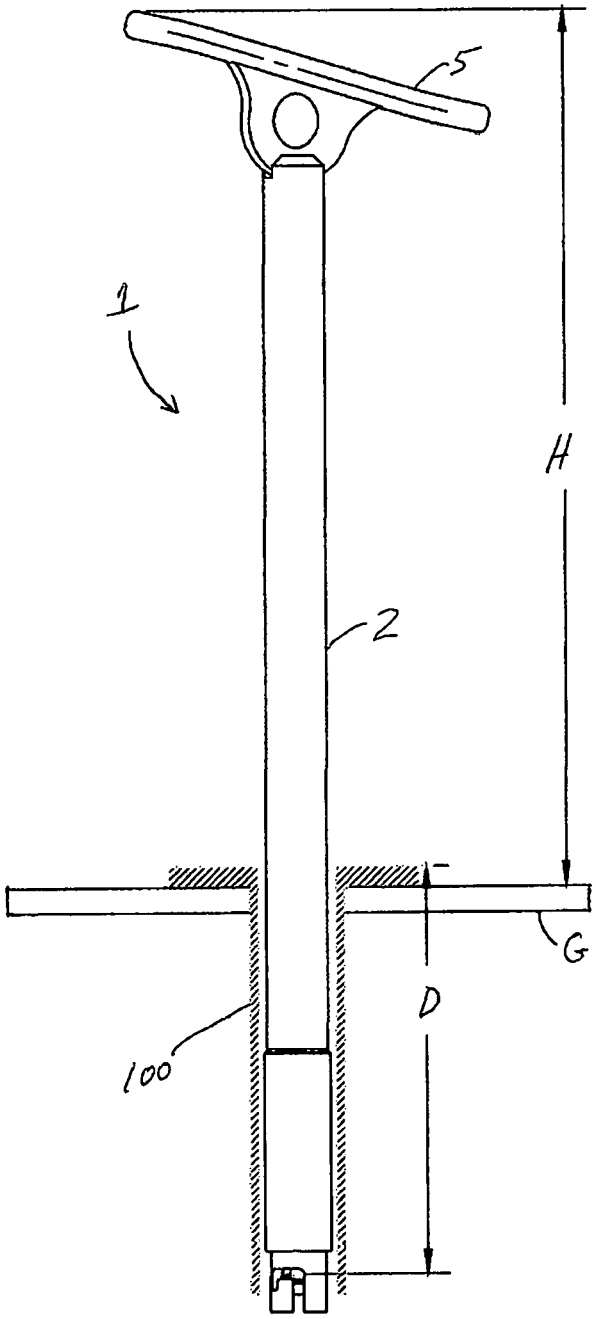
FIG. 8 is a side view of a tube assembly mounted in a rod holder.

As seen in FIGS. 7 and 8, the rod holder has a depth D from the cross member 101 to a top surface a rod holder 100, which is mounted at a top surface of the gunwale G. The depth D is standardized for rod holders and is typically 9.5 inches. It is preferable that the assembly have an overall length from the base end 3 over a top surface of the cleat 5 that puts the top of the top surface of the cleat dimension H over the top surface of the gunwale. The dimension H is at least 15 inches. A suitable range for the dimension H is 15-30 inches and the most preferred overall length results in a dimension H of 20.39 inches. The plate of the rod holder 100 that sits atop the gunwale has a thickness of ¼ inch which would make the overall length of the assembly 29.64 inches for the most preferred length. As seen in FIGS. 7 and 8, the cleat can be disposed at an angle to accommodate the rod holder 100 being disposed at an angle in the vessel V.

The invention claimed is:

1. A tube guide assembly for mounting in a rod holder of a vessel, the rod holder having a depth from a cross member to a top surface, the assembly for securing a mooring line to the vessel, the assembly comprising:

a tube having a longitudinal axis and a base end dimensioned for being disposed in the rod holder and engaging the cross member, said tube having a second end opposite said base end, said second end having a cleat for securing the mooring line, said tube having inverted substantially J-shaped slots opposite one another for receiving the cross member therein;

a spring-loaded lock assembly disposed in said tube, said lock assembly having a plunger for pressing against the cross member and locking the cross member in said J-shaped slots.

2. The tube assembly according to claim 1, wherein said lock assembly includes a spring, a locking collar fixed in said tube and a plunger ring fixed to said plunger, said plunger including a shaft, said spring being retained on said shaft between said locking collar and said plunger ring.

3. The tube assembly according to claim 2, wherein said lock assembly includes a male fastener affixing said plunger ring to said shaft, said spring being retained on said shaft between said locking collar and said plunger ring.

4. The tube assembly according to claim 2, further comprising a roll pin, said locking collar having a transverse collar hole, said tube having a transverse wall hole corresponding to said collar hole and said roll pin being disposed in said transverse wall hole and said collar hole for securing the lock assembly in said tube.

5. The tube assembly according to claim 4, further comprising a sleeve disposed over said tube at said base end, said sleeve disposed over said roll pin for retaining said roll pin in the locking collar.

6. The tube assembly according to claim 5, wherein said sleeve is made of Delrin.

7. The tube assembly according to claim 1, where said cleat has a base and said base has a substantially round hole formed through said base.

8. The tube assembly according to claim 7, wherein edges of said hole have a corner radius to prevent the mooring line from chafing.

9. The tube assembly according to claim 1, wherein said substantially J-shaped slots have insertion legs opening into a circumferential edge of said base end that extend substantially parallel to said longitudinal axis, said J-shaped slots include distal longitudinal legs spaced apart from said insertion legs that extend substantially parallel to said insertion legs, said distal longitudinal legs have terminal ends, said J-shaped slots have transverse portions that connect said insertion legs to said distal legs, said plunger presses said terminal ends against the cross member to seat and lock said tube in the rod holder.

10. A tube guide assembly for mounting in a rod holder of a vessel, the rod holder having a top surface mounted at a gunwale top surface, the assembly for securing a mooring line to the vessel, the assembly comprising:

a tube having a longitudinal axis and a base end dimensioned for being disposed in the rod holder and engaging the cross member, said tube having a second end opposite said base end, said second end having a cleat for securing the mooring line, said tube having a length from said base end over said cleat for disposing a top surface of said cleat at least 15 inches over the gunwale top surface for supporting the mooring line above engine cowling of an outboard engine mounted on the vessel and preventing the mooring line from damaging the engine cowling when said base end is disposed in the rod holder engaged with the cross member.

11. A tube guide assembly for mounting in a rod holder of a vessel, the rod holder having a cross member, the vessel having an outboard motor mounted thereon, the outboard motor having an engine cowling with an uppermost surface, the assembly for securing a mooring line to the vessel, the assembly comprising:

a tube having a longitudinal axis and a base end dimensioned for being disposed in the rod holder and engaging the cross member, said tube having a second end opposite said base end, said second end having a cleat for securing the mooring line, said tube having a length for disposing said cleat above the uppermost surface of the engine cowling when said base end is disposed in the rod holder engaged with the cross member, said cleat having a base, said base having a substantially round hole formed through said base and edges of said hole having a corner radius to prevent the mooring line from chafing.

* * * * *